US009464411B2

(12) United States Patent
Tanaka et al.

(10) Patent No.: US 9,464,411 B2
(45) Date of Patent: Oct. 11, 2016

(54) GROUND ENGAGING TOOL

(71) Applicant: KOMATSU LTD., Tokyo (JP)

(72) Inventors: Kenichi Tanaka, Jiangsu (CN); Tatsuo Aira, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/995,272

(22) Filed: Jan. 14, 2016

(65) Prior Publication Data

US 2016/0130789 A1 May 12, 2016

Related U.S. Application Data

(62) Division of application No. 14/234,883, filed as application No. PCT/JP2013/067486 on Jun. 26, 2013, now Pat. No. 9,267,270.

(30) Foreign Application Priority Data

Dec. 18, 2012 (JP) ..... 2012-275319

(51) Int. Cl.
*E02F 9/28* (2006.01)
*E02F 3/40* (2006.01)

(52) U.S. Cl.
CPC ..... *E02F 9/2825* (2013.01); *E02F 3/40* (2013.01); *E02F 9/2833* (2013.01); *E02F 9/2858* (2013.01)

(58) Field of Classification Search
CPC ... E02F 9/2808; E02F 9/2816; E02F 9/2825; E02F 9/2833; E02F 9/2858
USPC ..... 37/452, 453, 455, 456
See application file for complete search history.

(56) References Cited

U.S. PATENT DOCUMENTS

| | | | |
|---|---|---|---|
| 1,874,783 | A | 8/1932 | Cortright |
| 1,951,988 | A | 3/1934 | Cortright |
| 2,689,419 | A | 9/1954 | Daniels et al. |
| 2,874,491 | A | 2/1959 | Larsen |

(Continued)

FOREIGN PATENT DOCUMENTS

| | | | |
|---|---|---|---|
| CN | 101099005 | A | 1/2008 |
| CN | 202370031 | U | 8/2012 |

(Continued)

OTHER PUBLICATIONS

The International Search Report for the corresponding international application No. PCT/JP2013/067486, issued on Jul. 30, 2013.

*Primary Examiner* — Gary Hartmann
(74) *Attorney, Agent, or Firm* — Global IP Counselors, LLP

(57) ABSTRACT

A ground engaging tool includes a ground engaging tool body, an excavating tooth, and an adapter. A fixed portion of the adapter is fixed to the ground engaging tool body, and an insertion portion of the adapter protrudes from the ground engaging tool body in a first direction. The excavating tooth has a tooth body, an insertion cavity and a supporting portion. The insertion cavity is formed in a base end face of the tooth body. The excavating tooth is attached to the adapter such that the insertion portion of the adapter is inserted into the insertion cavity of the excavating tooth. The supporting portion projects from an innermost part of the insertion cavity. The supporting portion of the excavating tooth opposes a front end of the insertion portion of the adapter such that a gap exists between the supporting portion and the front end of the insertion portion.

9 Claims, 9 Drawing Sheets

(56) References Cited

U.S. PATENT DOCUMENTS

| | | | | | |
|---|---|---|---|---|---|
| 2,891,333 | A * | 6/1959 | Van Buskirk | E02F 9/2825 | 37/452 |
| 2,934,842 | A | 5/1960 | Buskirk | | |
| 3,453,755 | A | 7/1969 | Trudeau | | |
| 3,496,658 | A | 2/1970 | Eyolfson | | |
| 5,144,762 | A | 9/1992 | Robinson | | |
| 5,423,138 | A | 6/1995 | Livesay et al. | | |
| 5,709,043 | A * | 1/1998 | Jones | E02F 9/2825 | 37/455 |
| 5,966,849 | A * | 10/1999 | Moehnke | E02F 3/58 | 172/719 |
| D436,116 | S * | 1/2001 | Clendenning | D15/29 | |
| D446,224 | S * | 8/2001 | Clendenning | D15/29 | |
| 7,069,676 | B2 * | 7/2006 | Robinson | E02F 9/2833 | 37/455 |
| 7,730,651 | B2 * | 6/2010 | Carpenter | E02F 9/28 | 37/452 |
| 7,980,011 | B2 * | 7/2011 | Ruvang | E02F 9/2825 | 37/452 |
| 8,356,432 | B2 | 1/2013 | Carpenter | | |
| 8,904,677 | B2 | 12/2014 | Cui | | |
| 9,267,270 | B2 * | 2/2016 | Tanaka | E02F 9/2825 | |
| 2001/0052196 | A1 | 12/2001 | Pippins | | |
| 2008/0201996 | A1 | 8/2008 | Pasqualini | | |
| 2015/0013198 | A1 | 1/2015 | Tanaka et al. | | |

FOREIGN PATENT DOCUMENTS

| | | | |
|---|---|---|---|
| JP | 60-14322 | U | 5/1975 |
| JP | 60-76149 | U | 5/1985 |
| JP | 2000-319943 | A | 11/2000 |
| JP | 2001-152479 | A | 6/2001 |
| JP | 2011-246974 | A | 12/2011 |

* cited by examiner

GROUND ENGAGING TOOL

CROSS-REFERENCE TO RELATED APPLICATIONS

This application is a continuation application of U.S. patent application Ser. No. 14/234,883 filed Jan. 24, 2014. The entire contents of U.S. patent application Ser. No. 14/234,883 are hereby incorporated herein by reference.

BACKGROUND

1. Field of the Invention

The present invention relates to a ground engaging tool used in a work machine, the ground engaging tool having an adapter and an excavating tooth attached to the adapter.

2. Background Information

A work machine such as a hydraulic excavator or the like is generally provided with a ground engaging tool such as a bucket or a ripper or the like. An adapter is secured at the lip end of the ground engaging tool. An excavating tooth that is a cutting edge is mounted to the adapter. An insertion cavity acceptable to the adapter is formed in the excavating tooth. The parts of the adapter inserted in the excavating tooth other than the front end portion are in contact with the inner surface of the insertion cavity (refer to Japanese Patent Laid-open No. 2011-246974 for example). As the excavating tooth is used repeatedly in excavation work it must be replaced as appropriate due to wearing of the outer surface and the inner surface.

SUMMARY

During excavation work, there is high stress on the contact surface of the excavating tooth and the adapter. Further, if the orientation of stress exerted on the excavating tooth changes, the excavating tooth may be shaky to some extent in relation to the adapter. Moreover, earth and sand or the like from outside may penetrate into the gap between the adapter and the excavating tooth. For this reason the contact surface of the adapter and the excavating tooth becomes worn. When the contact surface of the excavating tooth and the adapter becomes worn the excavating tooth becomes even more prone to be shaky in relation to the adapter, further aggravating the wearing. This vicious circle shortens the lifespan of the product.

In the light of the above described problem, the purpose of the present invention is to provide a ground engaging tool capable of suppressing such wear of the adapter and shakiness of the excavating tooth.

The ground engaging tool according to a first aspect of the present invention has an excavating tool body, an excavating tooth, and an adapter. The excavating tooth has a tooth body, an insertion cavity and a supporting portion. The tooth body extends in a first direction. The insertion cavity is formed in a base end face of the tooth body, and the supporting portion projects from an innermost part of the insertion cavity. The adapter has a fixed portion and an insertion portion. The fixed portion is fixed to the ground engaging tool body, and the insertion portion is inserted in the insertion cavity. The supporting portion opposes a front end of the insertion portion such that a gap exists between the supporting portion and the front end of the insertion portion.

In the ground engaging tool according to the first aspect of the present invention, contact between the supporting portion and the adapter can suppress shakiness of the excavating tooth in relation to the adapter, i.e., suppress rattling contact. Further, since earth and sand that penetrates from the gap between the adapter and the excavating tooth can be accommodated in the insertion cavity, wearing of the adapter or the excavating tooth due to such earth and sand can be suppressed. Again, as the formation of the pair of extending recesses enables contact of the corner part of the front end of the adapter with the inner wall of the insertion cavity to be suppressed, damage to the adapter and the tooth in the insertion cavity can be suppressed.

The ground engaging tool according to a second aspect of the present invention is the ground engaging tool according to the first aspect, wherein the excavating tooth has a pair of shaft holes. The pair of shaft holes is configured to pass through the tooth body along a second direction perpendicular to the first direction. Each pair of shaft holes is configured to connect to the insertion cavity. In a cross-section passing through the center of the pair of shaft holes and'parallel to the first and second directions, a gap between the supporting portion and the insertion portion along the first direction is not more than 5% of a gap between the supporting portion and a center axis of the pair of shaft holes along the first direction. The center axis extends in the second direction.

The ground engaging tool according to the second aspect of the present invention enables the front end of the insertion portion and the supporting portion to be in sufficient proximity. For this reason, when the excavating tooth is at an inclination, the tooth can be sufficiently retained on the adapter.

The ground engaging tool according to a third aspect of the present invention is the ground engaging tool according to the first aspect, wherein the tooth body includes a convex portion projecting from the base end face. The fixed portion includes a concave portion in which the convex portion is fitted.

In the ground engaging tool according to the eighth aspect of the present invention, the convex portion fitting into and engaging with the concave portion of the adapter enables shakiness of the excavating tooth in relation to the adapter to be suppressed.

The present invention provides a ground engaging tool capable of suppressing wear of the adapter and shakiness of the excavating tooth.

DETAILED DESCRIPTION OF EMBODIMENT(S)

An embodiment of the present invention will now be described with reference to the drawings. The embodiment described following uses as an example of a ground engaging tool, a bucket 100 used in a work machine such as a hydraulic excavator or the like.

Entire Constitution of the Bucket 100

Figure 1:
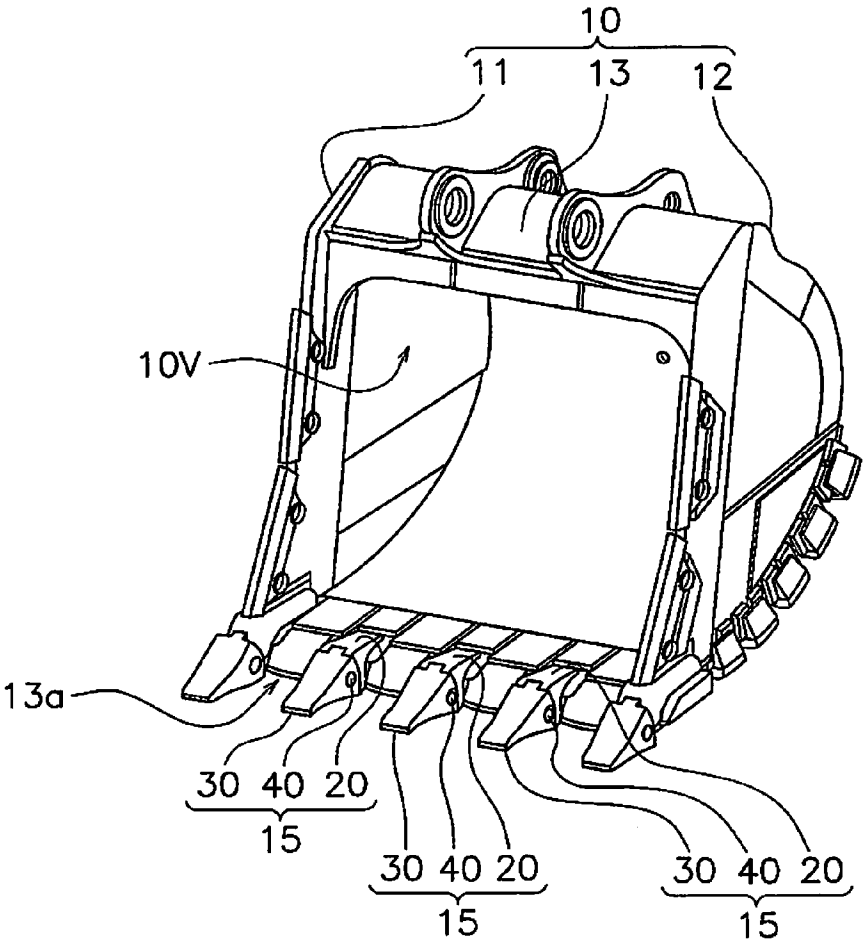
FIG. 1 is a perspective view of the bucket.
Figure 2:
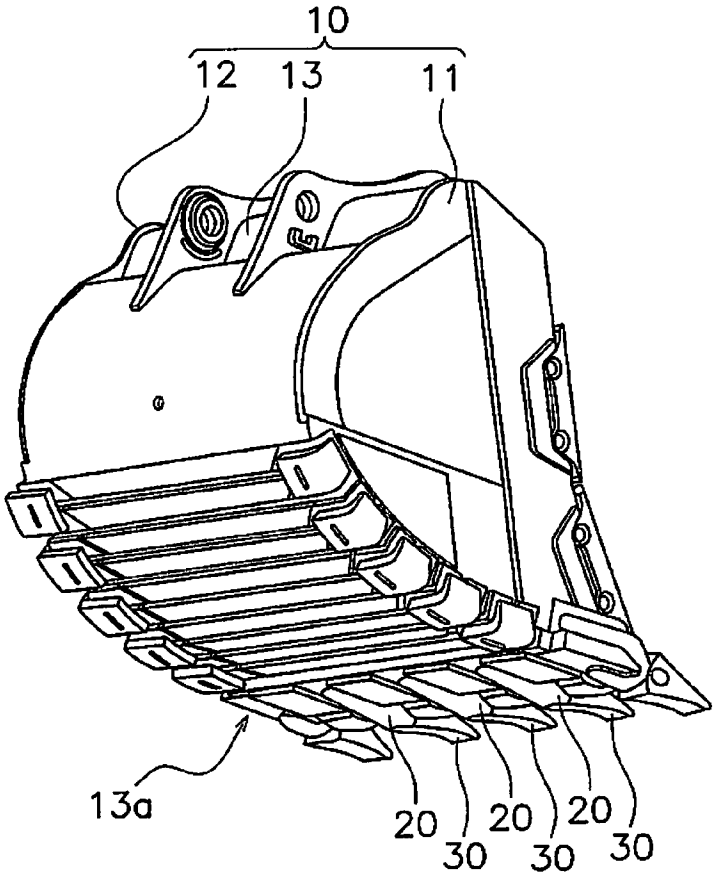
FIG. 2 is a perspective view of the bucket.

FIG. 1 and FIG. 2 provide perspective views of the bucket 100. As shown in FIG. 1 and FIG. 2 the bucket 100 is provided with a bucket body 10 and a plurality of tooth assemblies 15.

The bucket body 10 has a first side wall 11, a second side wall 12 and a wrapper 13. The first sidewall 11 and the second sidewall 12 are disposed opposing each other. The first sidewall 11 and the second sidewall 12 are each, in the side view, a flat plate, having a form enclosed by a substantially bow and bowstring shape. The wrapper 13 is a curved plate, positioned following the substantially bow shape of the first sidewall 11 and the second sidewall 12. The wrapper 13, and the first sidewall 11 and second sidewall 12 are secured together by welding. The wrapper 13 includes a lower edge portion 13*a* (that is to say, the lip end of the bucket). The first sidewall 11, the second sidewall 12, and the wrapper 13 form a holding space 10V for accommodating earth and sand.

Each of the plurality of tooth assemblies 15 is comprised of an adapter 20, an excavating tooth 30 (hereinafter referred to as "tooth 30"), and a retention mechanism 40.

Each adapter 20 is secured, at a predetermined distance, to the lower edge portion 13*a* of the wrapper 13. In preferred practice the adapter 20 is welded to the lower edge portion 13*a*. The adapter 20 when worn due to long term usage, is detached from the lower edge portion 13*a* and replaced with a new adapter 20. In this embodiment, that side of the adapter 20 that is secured to the wrapper 13 is referred to as the base end, and the opposite side to the base end is referred to as the front end of the adapter 20.

The tooth 30 is attached to the front end of the adapter 20. The tooth 30 has a claw shape, formed so as to become gradually thinner toward the tip end thereof. The tip end of the tooth 30 works as a cutting edge during excavation. A tooth 30 that has become worn due to long term usage is removed from the adapter 20 and replaced with a new tooth 30. In this embodiment, that end of the tooth 30 that is the cutting edge end is referred to as the tip end, and the end that attaches to the adapter 20 is referred to as the base end of the tooth 30.

The retention mechanism 40 is used for retaining the tooth 30 to the adapter 20. The retention mechanism 40 is arranged inside the tooth 30 and the adapter 20. Disassembling the retention mechanism 40 enables a worn tooth 30 to be removed from the adapter 20.

Configuration of the Tooth Assembly 15

Figure 3:
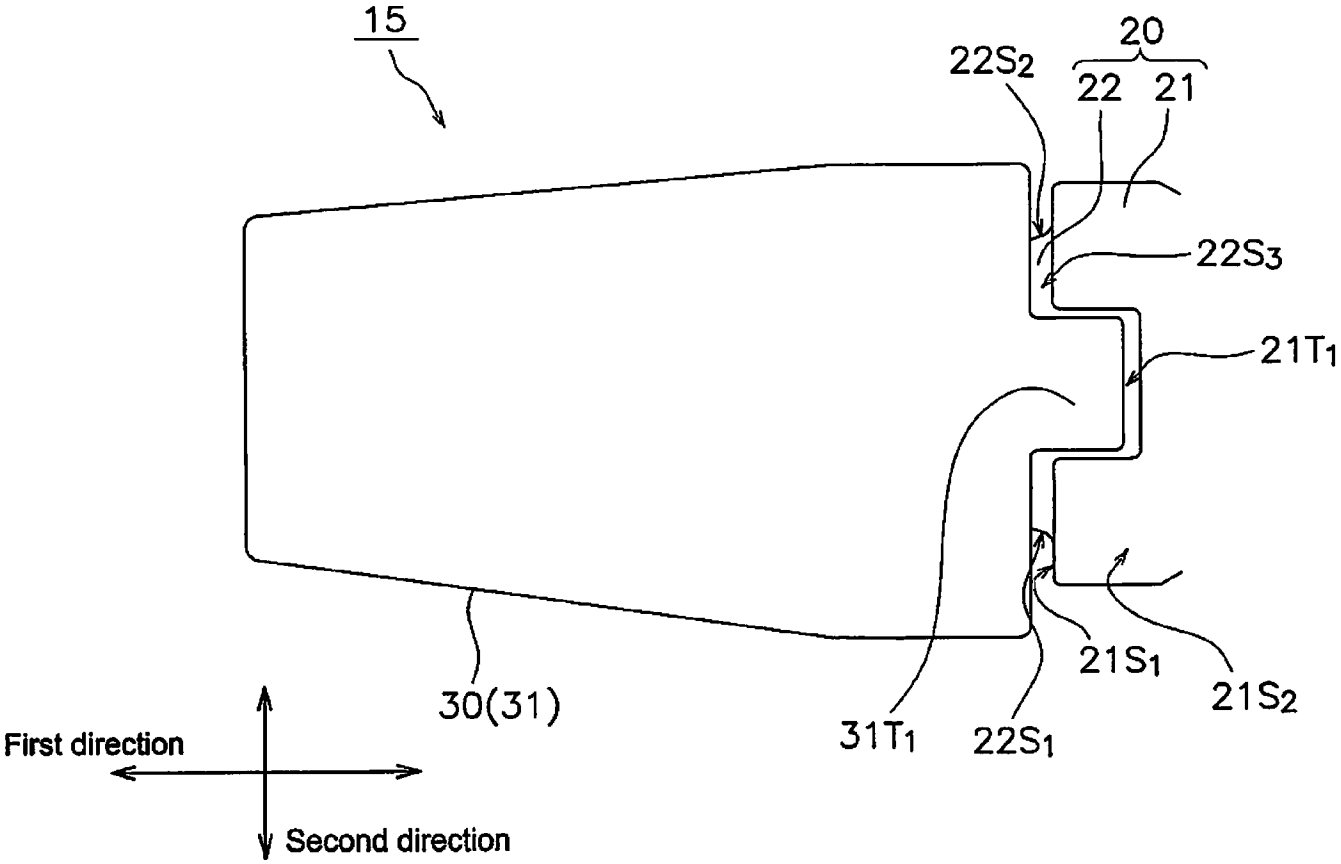
FIG. 3 is a top view of the tooth assembly.
Figure 4:
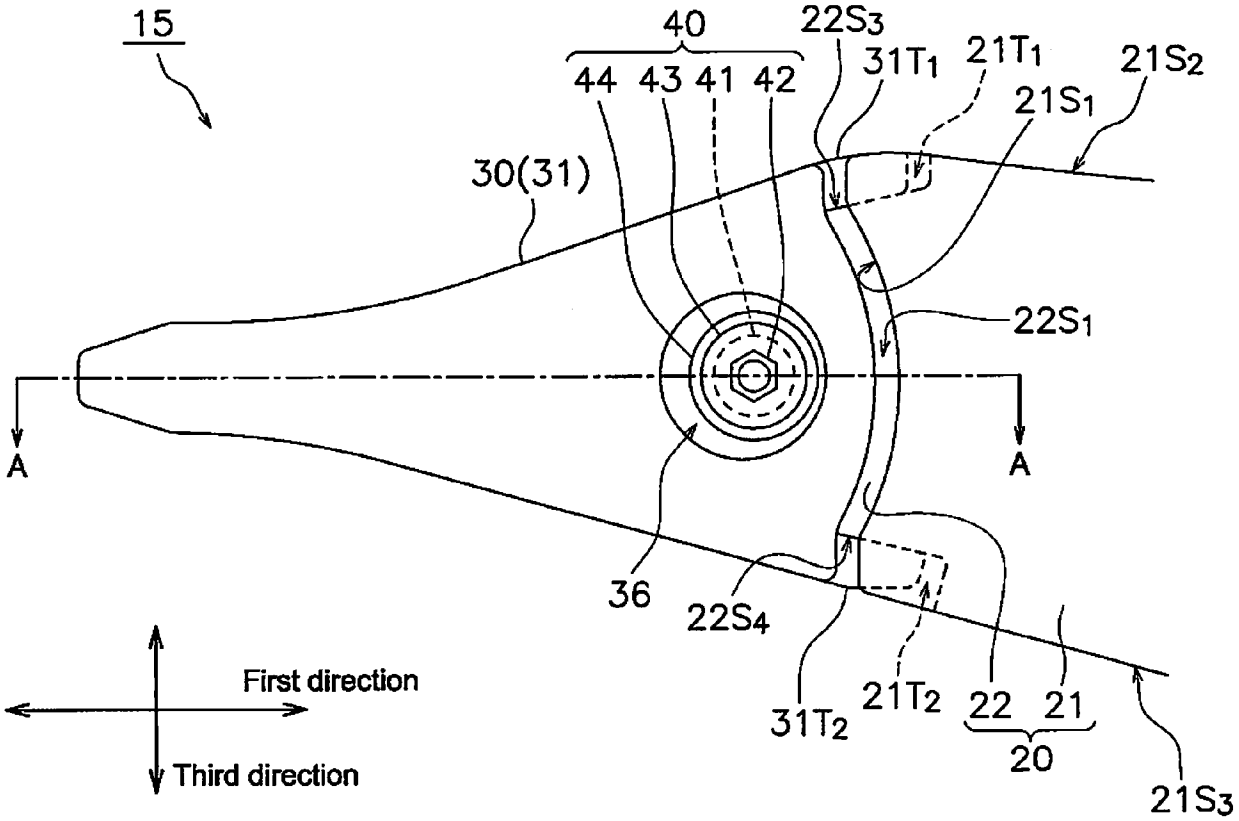
FIG. 4 is a side view of the tooth assembly.
Figure 5:
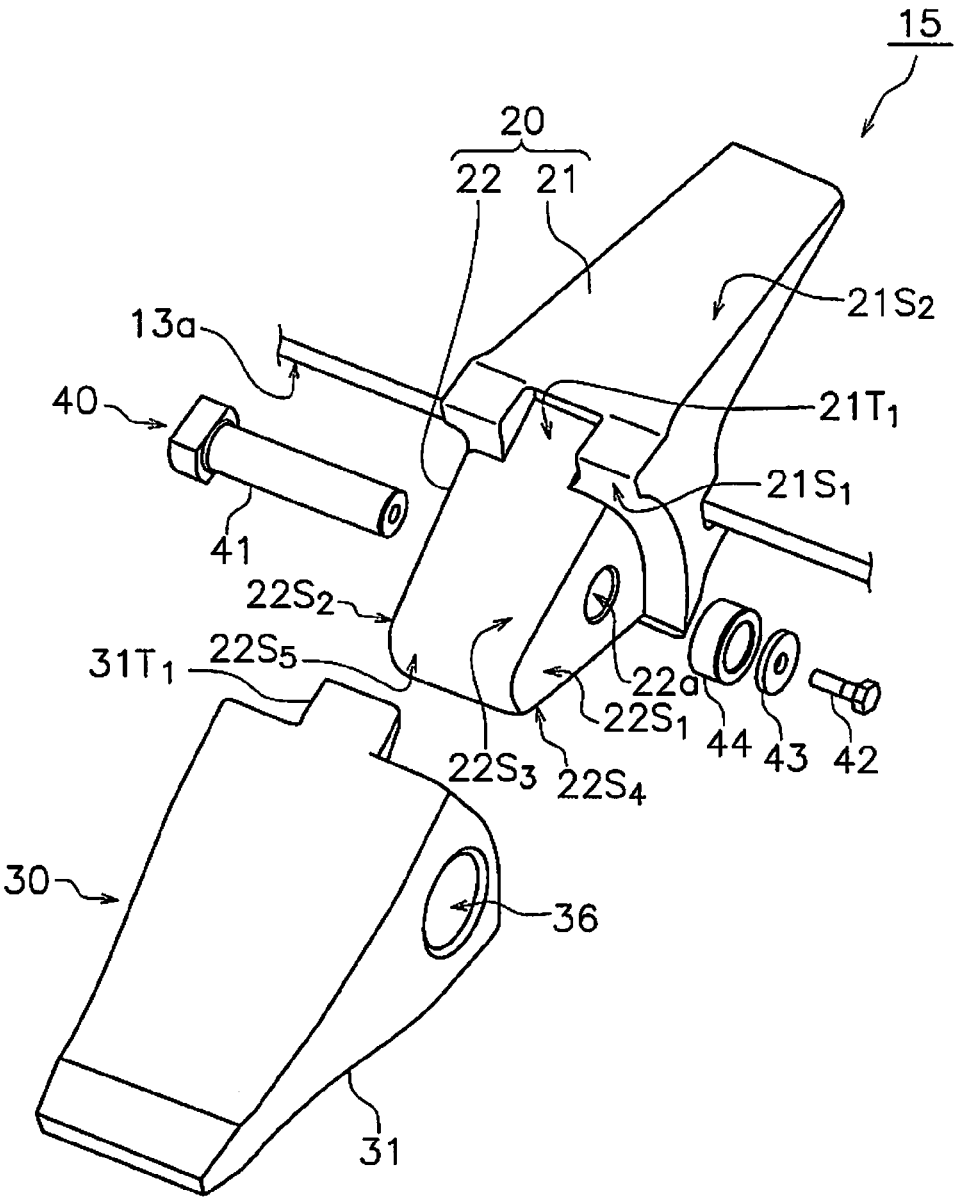
FIG. 5 is an exploded, perspective view of the tooth assembly.
Figure 6:
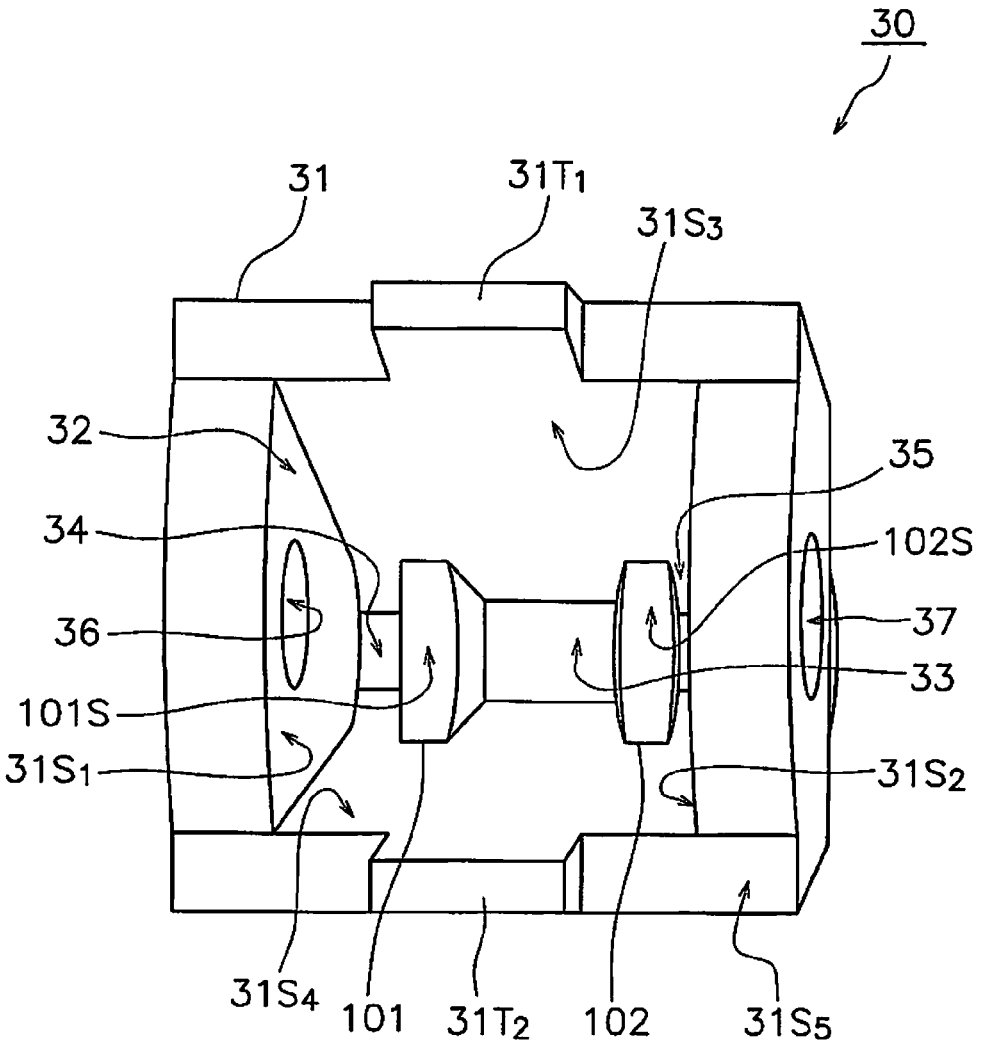
FIG. 6 is a perspective view of the excavating tooth.

FIG. 3 is a top view of the tooth assembly 15. FIG. 4 is a side view of the tooth assembly 15. FIG. 5 is an exploded, perspective view of the tooth assembly 15. FIG. 6 is a perspective view of the excavating tooth 30. In the following description, in the same manner as shown in FIG. 3 and FIG. 4, the direction in which the tooth body 31 extends (that is to say, the direction along which the base end and the tip end of the tooth 30 are joined), is termed the "first direction", the direction in which the tooth body 31 extends flat is termed the "second direction", while the direction perpendicular to the first direction and the second direction is termed the "third direction".

As shown in FIG. 5, the adapter 20 has a fixed portion 21 and an insertion portion 22. The fixed portion 21 is formed by two legs of the adapter 20 at the base end side thereof. The fixed portion 21 sandwiches the lower edge portion 13*a* of the bucket body 10. The fixed portion 21 is fixed to the lower edge portion 13*a* by welding or the like.

As shown in FIG. 3 through FIG. 5, the fixed portion 21 has a front face $\mathbf{21S_1}$, a top face $\mathbf{21S_2}$, a bottom face $\mathbf{21S_3}$, a first concave portion $\mathbf{21T_1}$ and a second concave portion $\mathbf{21T_2}$. The front face $\mathbf{21S_1}$ opposes the tooth 30 when the tooth 30 is attached to the adapter 20. The top face $\mathbf{21S_2}$ extends to the front face $\mathbf{21S_1}$. The bottom face $\mathbf{21S_3}$, disposed opposing the top face $\mathbf{21S_2}$, extends to the front face $\mathbf{21S_1}$. The first concave portion $\mathbf{21T_1}$ is formed in the front face $\mathbf{21S_1}$ and the top face $\mathbf{21S_2}$. The first concave portion $\mathbf{21T_1}$ forms a contiguous opening in the front face $\mathbf{21S_1}$ and in the top face $\mathbf{21S_2}$. A first convex portion $\mathbf{31T_1}$ of the tooth 30, described subsequently, is inserted to the first concave portion $\mathbf{21T_1}$. The second concave portion $\mathbf{21T_2}$ is formed in the front face $\mathbf{21S_1}$ and the bottom face $\mathbf{21S_3}$. The second concave portion $\mathbf{21T_2}$ forms a contiguous opening in the front face $\mathbf{21S_1}$ and the bottom face $\mathbf{21S_3}$. A second convex portion $\mathbf{31T_2}$ of the tooth 30, described subsequently, is inserted to the second concave portion $\mathbf{21T_2}$. The engagement of the first convex portion $\mathbf{31T_1}$ with the first concave portion $\mathbf{21T_1}$, and the engagement of the second convex portion $\mathbf{31T_2}$ with the second concave portion $\mathbf{21T_2}$ enable shakiness of the tooth 30 in the second direction to be suppressed. It is also possible however to attach to the fixed portion 21, a tooth according to the conventional art that does not provide the first convex portion $\mathbf{31T_1}$ and the second convex portion $\mathbf{31T_2}$.

The insertion portion 22 projects from the front face $\mathbf{21S_1}$ of the fixed portion 21. The insertion portion 22 inserts into an insertion cavity 32 of the tooth body 30, described subsequently (referring to FIG. 6). As shown in FIG. 3 through FIG. 5, the insertion portion 22 has a first side face $\mathbf{22S_1}$, a second side face $\mathbf{22S_2}$, a top face $\mathbf{22S_3}$, a bottom face $\mathbf{22S_4}$, a front end face $\mathbf{225_5}$ and an insertion hole 22*a*. The first side face $\mathbf{22S_1}$ and the second side face $\mathbf{22S_2}$ are disposed on mutually opposing sides. The top face $\mathbf{22S_3}$ and the bottom face $\mathbf{22S_4}$ are disposed on mutually opposing sides. The front end face $\mathbf{22S_5}$ extends to the first side face $\mathbf{22S_1}$, the second side face $\mathbf{225_2}$, the top face $\mathbf{22S_3}$ and the bottom face $\mathbf{22S_4}$. In this embodiment, the front end face $\mathbf{22S_5}$ curves smoothly from the top face $\mathbf{22S_3}$ to the bottom face $\mathbf{22S_4}$, however this configuration is not restrictive. It is suitable for the front end face $\mathbf{22S_5}$ to be for example, a flat face. The insertion hole 22*a* passes through the insertion portion 22 from the first side face $\mathbf{22S_1}$ to the second side face $\mathbf{22S_2}$. A pin 41 of the attachment mechanism 40, described subsequently, inserts into the insertion hole 22*a*.

FIG. 6 is a view of the excavating tooth 30 from the base end side. As shown in FIG. 6, the tooth 30 has the tooth body 31, the insertion cavity 32, a first shaft hole 36 and a second shaft hole 37.

As shown in FIG. 3 and FIG. 4, the tooth body 31 is formed in a shape tapering off in the first direction. Further, as shown in FIG. 6, the tooth body 31 is formed in a cup shape.

As shown in FIG. 6, the tooth body 31 has a first inner side face $\mathbf{31S_1}$, a second inner side face $\mathbf{31S_2}$, an inner upper face $\mathbf{31S_3}$, an inner lower face $\mathbf{31S_4}$, a rear face $\mathbf{31S_5}$ (an example of base end face), a first convex portion first convex portion $\mathbf{31T_1}$, a second convex portion second convex portion $\mathbf{31T_2}$, a first supporting portion 101, and a second supporting portion 102. The first inner side face $\mathbf{31S_1}$ opposes the first side face $\mathbf{22S_1}$ of the insertion portion 22. It is suitable for an extremely small gap to be provided between the first inner side face $\mathbf{31S_1}$ and the first side face $\mathbf{22S_1}$. The second inner side face $\mathbf{31S_2}$ opposes the second side face $\mathbf{22S_2}$ of the insertion portion 22. It is suitable for an extremely small gap to be provided between the second inner side face $\mathbf{31S_2}$ and the second side face $\mathbf{22S_2}$. The inner upper face $\mathbf{31S_3}$ is in contact with the top face $\mathbf{22S_3}$ of the insertion portion 22.

The inner lower face $31S_4$ is in contact with the bottom face $22S_4$ of the insertion portion 22. The rear face $31S_5$ opposes the front face $21S_1$ of the fixed portion 21. It is suitable for an extremely small gap to be provided between the rear face $31S_5$ and the front face $21S_1$. The insertion cavity 32 is formed in the base end face of the rear face $31S_5$.

The first convex portion $31T_1$ projects from the rear face $31S_5$. The first convex portion $31T_1$ inserts in the first concave portion $21T_1$ of the fixed portion 21. A gap is provided between the first convex portion $31T_1$ and the first concave portion $21T_1$. The second convex portion $31T_2$ projects from the rear face $31S_5$ at the opposite side to the first convex portion $31T_1$, the insertion cavity 32 disposed therebetween. The second convex portion $31T_2$ is inserted to the second concave portion $21T_2$ of the fixed portion 21.

A first supporting portion 101 and a second supporting portion 102 (an example of the pair of supporting portions), mutually separated in the orientation of the second direction, project from the innermost part of the insertion cavity 32. The first supporting portion 101 and the second supporting portion 102 are disposed on either side of a sign pocket 33. In other words, the sign pocket 33 is the depressed portion between the first supporting portion 101 and the second supporting portion 102. The first supporting portion 101 has a first supporting face 101S. The first supporting face 101S forms part of the bottom face of the insertion cavity 32. The first supporting face 101S opposes the front end face $22S_5$ of the insertion portion 22. A predetermined, extremely small gap is provided between the first supporting face 101S and the front end face $22S_5$. The second supporting portion 102 has a second supporting face 102S. The second supporting face 102S forms a part of the bottom face of the insertion cavity 32. The second supporting face 102S opposes the front end face $22S_5$ of the insertion portion 22. A predetermined, extremely small gap is provided between the second supporting face 102S and the front end face $22S_5$.

Figure 7:
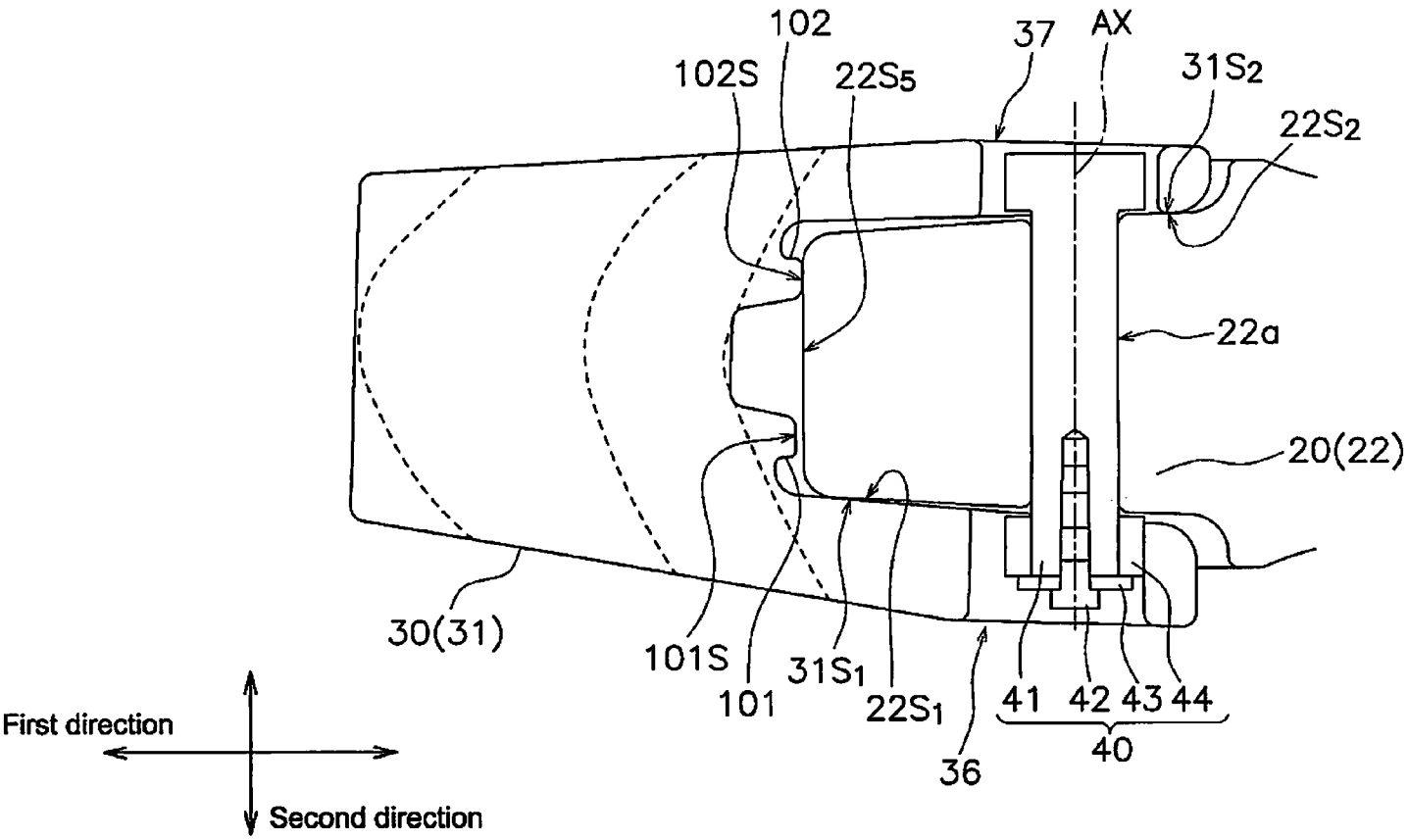
FIG. 7 is a cross-sectional view along A-A in FIG. 4 (during shaking)

Here, FIG. 7 is a cross-sectional view along A-A in FIG. 4. However, the tooth 30 and the adapter 20 shown in FIG. 7 have been used for some time in excavation work, and the tooth 30 shakes in relation to the adapter 20, in the second direction. That is to say, FIG. 7 shows the condition in which the places of engagement between the tooth 30 and the adapter 20 are worn due to usage in excavation work, such that the shakiness of the tooth 30 in relation to the adapter 20 has become substantial.

As shown in FIG. 7, the front end portion of the first inner side face $31S_1$ contacts the front end portion of the first side face $22S_1$. Further, the rear end portion of the second inner side face $31S_2$ contacts the rear end portion of the second side face $22S_2$. The tooth 30 and the adapter 20, at the point in time when there has been no usage for excavation work, are in contact at these two places. As the wearing of the places of engagement between the tooth 30 and the adapter 20 in line with usage in excavation work proceeds and the rattling of the tooth 30 increases, the second supporting face 102S and the front end face $22S_5$ come further into contact. In this way, the tooth 30, inclined in relation to the insertion portion 22, is supported at three points by the adapter 20. Precisely because the second supporting face 102S contacts the front end face $22S_5$, support for the tooth 30 is provided at both sides of and the front of the adapter 20.

Note that, while not shown in the drawing, when the tooth 30 is inclined in the opposite orientation to that shown in FIG. 7, the rear end portion of the first inner side face $31S_1$ and the rear end portion of the first side face $22S_1$ are in contact, the front end portion of the second inner side face $31S_2$ and the front end portion of the second side face $22S_2$ are in contact, and the first supporting face 101S and the front end face $22S_5$ are in contact. Accordingly, in the same manner as shown in FIG. 7, the tooth 30 is supported at three points by the adapter 20.

As described above, in comparison to a tooth of the conventional art, the tooth 30 according to this embodiment is capable of suppressing an increase in rattling of the tooth due to excavation work. Because rattling of the tooth promotes wearing of the portions of contact, shortening the lifespan of the tooth and the adapter, the tooth 30 according to this embodiment is capable of extending the lifespan of the components in comparison to a tooth of the conventional art.

The insertion cavity 32, as shown in FIG. 6, is formed in the rear face $31S_5$ (base end face) of the tooth body 31. The insertion cavity 32 is a cavity for insertion of the insertion portion 22 of the adapter 20. The insertion cavity 32 has a form that tapers in conformance with the external form of the adapter 20. Part of the bottom face of the insertion cavity 32 is the first supporting face 101S and the second supporting face 102S. Further, the inner peripheral surface of the insertion cavity 32 is the first inner side face $31S_1$, the second inner side face $31S_2$, the inner upper face $31S_3$ and the inner lower face $31S_4$.

The insertion cavity 32 includes the sign pocket 33, a first extending recess 34, and a second extending recess 35. The sign pocket 33, as shown in FIG. 6, is formed in the middle part along the second direction, of the bottom face side of the insertion cavity 32. The sign pocket 33 is formed between the first supporting portion 101 and the second supporting portion 102 of the tooth body 31. In other words, the sign pocket 33 is a depressed portion between the first supporting portion 101 and the second supporting portion 102.

The function of the sign pocket 33 will now be described with reference to FIG. 7.

Firstly, the sign pocket 33 performs the function of accumulating earth and sand that penetrates from the gap between the adapter 20 and the tooth 30. Accordingly, earth and sand that penetrates can be prevented from becoming inserted between the adapter 20 and the tooth 30, more specifically, between each of the first supporting portion 101 and the second supporting portion 102 of the insertion portion 22. If earth and sand becomes lodged between each of the first supporting portion 101 and the second supporting portion 102 of the insertion portion 22, wearing of both supporting portions and the peripheral parts thereof is aggravated, and the rattling of the tooth 30 increases. If this rattling increases the wearing is further increased, shortening the lifespan of the tooth 30 and the adapter 20. The sign pocket 33, as described above, functions to accumulate penetrating earth and sand, thus enabling wearing of the portions of contact between the tooth 30 and the adapter 20 to be suppressed.

In FIG. 7 the dashed line represents the line of wear indicating the hypothetical state of wearing of the tooth 30. As shown in FIG. 7, after both sides of the tip end of the tooth 30 are damaged due to wear at the initial stage, the tip end of the tooth 30 wears at the same speed universally. As the wearing proceeds the sign pocket 33 becomes exposed at the tip end of the tooth 30. An operator then recognizes that that the sign pocket 33 is becoming exposed at the tip end of the tooth 30, in other words, the operator recognizes that a hole has opened in the tip end of the tooth 30, such that the usable lifespan of the tooth 30 is approaching the end. Note that in preferred practice, the sign pocket 33 is designed such that, in the normal usage environment, exposure thereof appears in front of the first extending recess 34 and the second extending recess 35. The relationship between the positioning of the sign pocket 33, and the first extending recess 34 and the second extending recess 35 is described subsequently.

Figure 8:
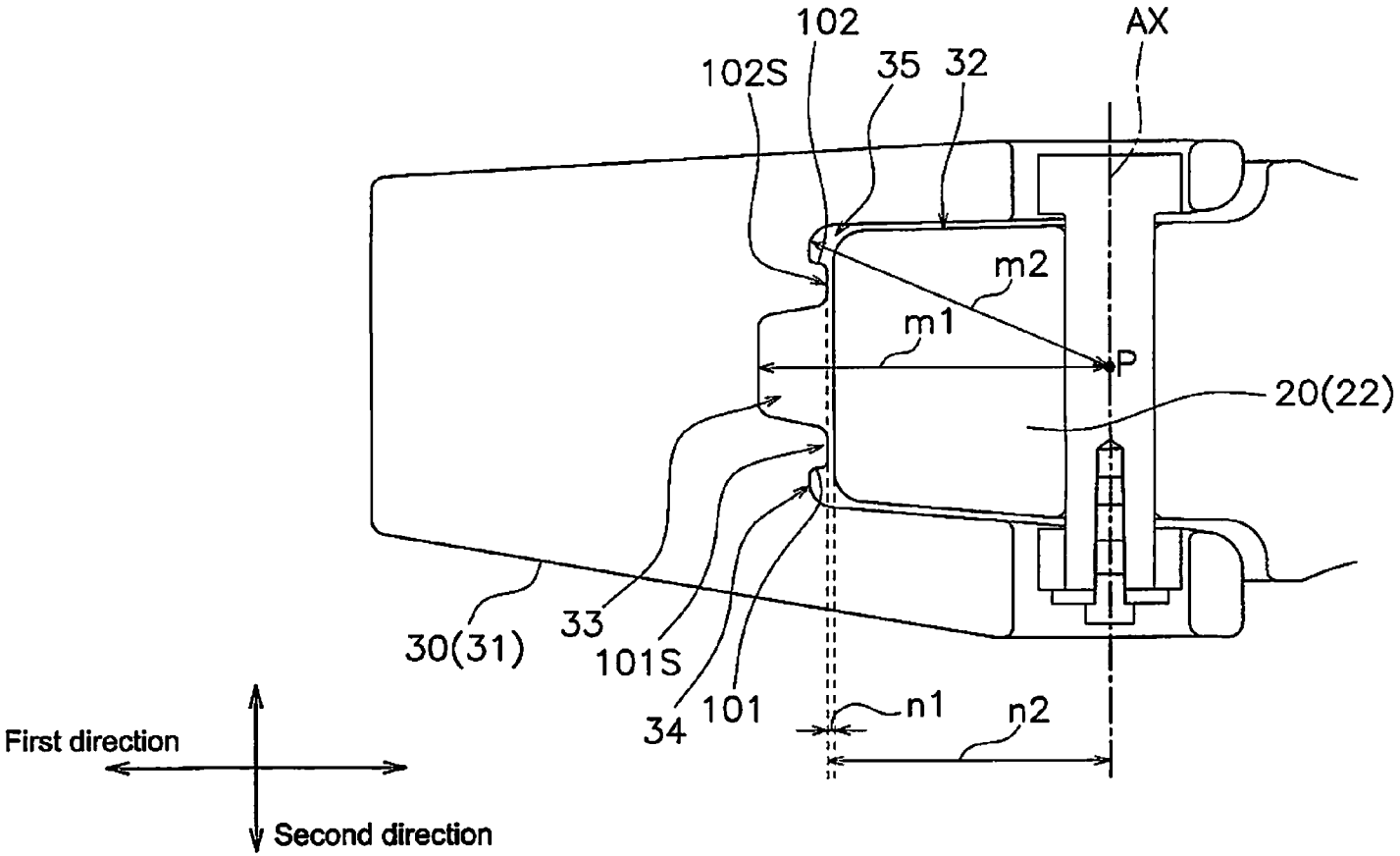
FIG. 8 is a cross-sectional view along A-A in FIG. 4 (normal condition)

The first extending recess 34 and the second extending recess 35 (an example of a pair of extending recesses) are part of the insertion cavity 32 (refer FIG. 8). The first extending recess 34 and the second extending recess 35 respectively are formed one on either side, in the second direction, of the first supporting portion 101 and the second supporting portion 102. Basically, the first extending recess 34 is formed on the opposing side to the sign pocket 33, the first supporting portion 101 positioned therebetween. The second extending recess 35 is formed on the opposing side to the sign pocket 33, the second supporting portion 102 positioned therebetween. The first extending recess 34 and the second extending recess 35 are each shallower and thinner than the sign pocket 33. This kind of first extending recess 34 and second extending recess 35 are provided such that the corner portions of the adapter 20 (that is to say, both end portions in the second direction, of the front end of the adapter 20) do not contact the inner wall of the insertion cavity 32. In preferred practice, even when the tooth 30 is inclined in relation to the adapter 20 the corner portions of the adapter 20 should not contact the inner wall of the tooth 30.

As shown in FIG. 6 and FIG. 7, the first shaft hole 36 and the second shaft hole 37 (an example of a pair of shaft holes) both pass through the tooth body 31. The first shaft hole 36 and the second shaft hole 37 respectively, connect to the insertion cavity 32. The first shaft hole 36 and the second shaft hole 37 are formed along straight lines oriented in the second direction. In FIG. 7, the center line AX of the first shaft hole 36 and the second shaft hole 37 is indicated by the dotted and dashed line. As shown in FIG. 7 the respective end portions of the retention mechanism 40 are accommodated in the first shaft hole 36 and the second shaft hole 37 respectively.

The retention mechanism 40, as shown in FIG. 5, has a pin 41, a bolt 42, a washer 43, and a bushing 44. As shown in FIG. 7, the pin 41 is inserted in the insertion hole 22*a* of the insertion portion 22. According to this embodiment, the central axis of the pin 41 is substantially in agreement with the center line AX of the first shaft hole 36 and the second shaft hole 37. The bolt 42 is secured to an end of the pin 41 via the washer 43 and the bushing 44. The washer 43 and the bushing 44 are accommodated inside the first shaft hole 36.

Positional Relationship of the Adapter 20 and the Tooth 30

The positional relationship of the adapter 20 and the tooth 30 will now be described with reference to the drawings. FIG. 8 is a cross-sectional view along A-A in FIG. 4. In contrast to FIG. 7 however, FIG. 8 shows the condition in which the tooth 30 does not shake in relation to the adapter 20 in the second direction. In FIG. 8, the middle position above the center line AX of the first supporting portion 101 and the second supporting portion 102 is indicated in the drawing as "reference point P". That is to say, the reference point P is the center in the second direction of the tooth body 31 along the centerline AX.

As shown in FIG. 8, the interval m1 between the innermost part of the sign pocket 33 and the reference point P is greater than the interval m2 between the innermost part of the second extending recess 35 and the reference point P. Although not shown in the drawing, the interval between the innermost part of the first extending recess 34 and the reference point P is the same as the interval m2 between the innermost part of the second extending recess 35 and the reference point P. The innermost part of the first extending recess 34 or of the second extending recess 35 is an example of the innermost part of the insertion cavity 32. It is preferable that the interval m1 be not less than 1.05 times the interval m2, and more preferably, not less than 1.10 times the interval m2.

Further, as shown in FIG. 8, it is preferable that the extremely small gap n1 between the front end of the insertion portion 22, and the first supporting portion 101 and the second supporting portion 102 be not greater than 5% of the gap n2 between the centerline AX, and the first supporting portion 101 and the second supporting portion 102, and more preferably, not greater than 2%.

Actions and Effects (1) The tooth 30 according to this embodiment of the present invention has the tooth body 31, the insertion cavity 32, and the first supporting portion 101 and second supporting portion 102 (example of a pair of supporting portions) projecting from the innermost part of the insertion cavity 32. The insertion cavity 32 has the sign pocket 33 (example of a depressed portion) formed between the first supporting portion 101 and the second supporting portion 102, and, the first extending recess 34 and the second extending recess 35 (an example of a pair of extending recesses) formed on both sides of the first supporting portion 101 and the second supporting portion 102.

Accordingly, shakiness, or what is known as rattling, of the tooth 30 in relation to the adapter 20 due to the first supporting portion 101 or the second supporting portion 102 being brought into contact with the adapter 20, can be suppressed. Further, as earth and sand penetrating from the gap between the adapter 20 and the tooth 30 can be accommodated in the sign pocket 33, wearing of the adapter 20 or the tooth 30 caused by such penetrating earth and sand can be suppressed. Moreover, formation of the first extending recess 34 and the second extending recess 35 enables contact of the corner parts at the front end of the adapter 20 with the inner wall of the insertion cavity 32 to be suppressed, thus damage to the adapter 20 and the tooth 30 inside the sign pocket 33 can be suppressed.

(2) The interval m1 between the reference point P and the innermost part of the sign pocket 33 is greater than the interval m2 between the reference point P and innermost part of the insertion cavity 32.

Accordingly, when wearing of the tooth body 31 has advanced, the sign pocket 33 is caused to become exposed in front of the insertion cavity 32. Accordingly, the time to change the tooth 30 can be recognized well in advance of the insertion portion 22 becoming damaged.

(3) The first extending recess 34 and the second extending recess 35 are shallower and narrower than the sign pocket 33.

Accordingly, in the normal usage environment, the sign pocket 33 can be caused to become exposed before the first extending recess 34 and the second extending recess 35 become. For this reason, the time to change the tooth 30 can be recognized well in advance of the insertion portion 22 becoming damaged.

(4) The first supporting portion 101 and the second supporting portion 102 oppose at a predetermined distance, the front end portion of the adapter 20 inserted in the insertion cavity 32.

Accordingly, shakiness of the adapter can be restricted within an appropriate range.

(5) The tooth body 31 has the first convex portion 31$T_1$ projecting from the rear face 31$S_5$ (an example of a base end face).

Accordingly, engagement of the first convex portion 31$T_1$ in the first concave portion 21$T_1$ of the fixed portion 21 enables shakiness of the tooth 30 in relation to the adapter 22 to be suppressed. This effect is also obtained from the second convex portion 31$T_2$.

(6) The interval n1 between the front end of the insertion portion 22, and the first supporting portion 101 and the second supporting portion 102 is not greater than 5% of the interval n2 between the centerline AX, and the first supporting portion 101 and second supporting portion 102.

Accordingly, the front end of the insertion portion 22 is capable of being positioned sufficiently proximal to the first supporting portion 101 and the second supporting portion 102. Thus, when the tooth 30 is inclined, the tooth 30 can be sufficiently retained by the adapter 20.

Other Embodiments

The invention is not limited to the embodiment described above. It is therefore understood that numerous modifications and variations can be devised without departing from the scope of the invention.

For example, in the above described embodiment, the description employed a bucket 100 as an example of a ground engaging tool, however this description is illustrative and not restrictive. For example, a ripper attached to a bulldozer or the like could also be cited as an example of the ground engaging tool.

Figure 9:
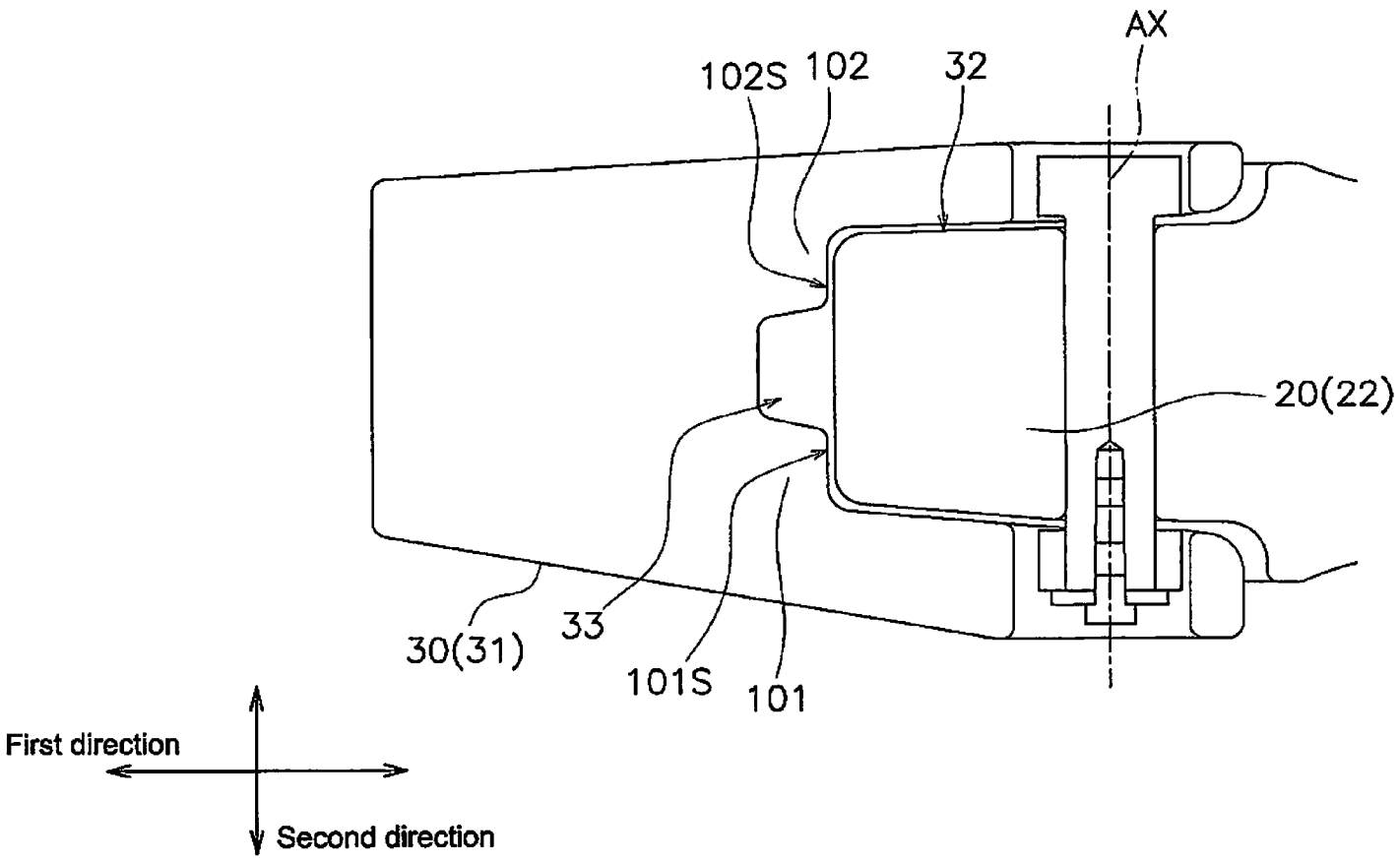
FIG. 9 is a cross-sectional view showing the configuration of the excavating tooth.

Again, in the above-described embodiment, the insertion Cavity 32 of the tooth 30 has the first extending recess 34 and the second extending recess 35, however this description is illustrative and not restrictive. As shown in FIG. 9, it is also suitable for the insertion cavity 32 to not be provided with the first extending recess 34 and the second extending recess 35. In this case, the corner of the first supporting portion 101 and the first inner side face 31$S_1$ and the corner of the second supporting portion 102 and the second inner side face 31$S_2$ become the innermost parts of the insertion cavity 32.

Further, in the above described embodiment, the tooth body 31 has the first convex portion 31$T_1$ and the second convex portion 31$T_2$, however this description is illustrative and not restrictive. It is also suitable for the tooth body 31 not to be provided with the first convex portion 31$T_1$ and the second convex portion 31$T_2$, or to be provided with only one from among the first convex portion 31$T_1$ and the second convex portion 31$T_2$.

What is claimed is:

1. A ground engaging tool comprising:

a ground engaging tool body;

an excavating tooth having a tooth body, an insertion cavity and a supporting portion, the tooth body extending in a first direction, the insertion cavity being formed in a base end face of the tooth body, and the supporting portion projecting from an innermost part of the insertion cavity; and an adapter having a fixed portion and an insertion portion, the fixed portion being fixed to the ground engaging tool body, and the insertion portion extending from the fixed portion in the first direction and being inserted in the insertion cavity, the insertion portion including a front end face disposed at an opposite end of the insertion portion from the fixed portion in the first direction, the supporting portion being separated from the front end face of the insertion portion by a gap in the first direction such that a distance from the front end face to the fixed portion in the first direction is smaller than a distance from the supporting portion to the fixed portion.

2. The ground engaging tool according to claim 1, wherein the excavating tooth has a pair of shaft holes, the pair of shaft holes pass through the tooth body along a second direction perpendicular to the first direction, and each of the pair of shaft holes connects to the insertion cavity, in a cross-section passing through the center of the pair of shaft holes and parallel to the first and second directions, the gap between the supporting portion and the front end face of the insertion portion along the first direction is not more than 5% of a gap between the supporting portion and a center axis of the pair of shaft holes along the first direction, the center axis extending in the second direction.

3. The ground engaging tool according to claim 1, wherein the tooth body includes a convex portion projecting from the base end face, and the fixed portion includes a concave portion with the convex portion fitted therein.

4. The ground engaging tool according to claim 1, wherein the tooth body includes a convex portion projecting from the base end face, and the fixed portion of the adapter includes a concave portion, the convex portion being fitted into the concave portion.

5. The ground engaging tool according to claim 1, wherein the excavating tool body is a bucket.

6. The ground engaging tool according to claim 1, wherein the supporting portion includes a first supporting and a second supporting portion, the first supporting portion and the second supporting portion being separated from each other along a second direction perpendicular to the first direction.

7. The ground engaging tool according to claim 2, wherein the supporting portion includes a first supporting and a second supporting portion, the first supporting portion and the second supporting portion being separated from each other along the second direction.

8. The ground engaging tool according to claim 2, wherein an insertion hole passes through the insertion portion of the adapter along the second direction, a pin is inserted through the pair of shaft holes and the insertion hole to attach the excavating tooth to the adapter.

9. A ground engaging tool comprising:

a ground engaging tool body;

an excavating tooth having a tooth body, an insertion cavity and a supporting portion, the tooth body extending in a first direction, the insertion cavity being formed in a base end face of the tooth body, and the supporting portion projecting from an innermost part of the insertion cavity, the excavating tooth having a pair of shaft holes that pass through the tooth body along a second direction perpendicular to the first direction, each of the shaft holes connecting to the insertion cavity; and an adapter having a fixed portion and an insertion portion, the fixed portion being fixed to the ground engaging tool body, and the insertion portion being inserted in the insertion cavity, the supporting portion opposing a front end of the insertion portion at a predetermined distance, the supporting portion including a first supporting and a second supporting portion, the first supporting portion and the second supporting portion being separated from each other along the second direction, in a cross-section passing through the center of the pair of shaft holes and parallel to the first and second directions, a gap between the supporting portion and the insertion portion along the first direction is not more than 5% of a gap between the supporting portion and a center axis of the pair of shaft holes along the first direction, the center axis extending in the second direction, the insertion cavity having a depressed portion and a pair of extending recesses, the depressed portion being formed between the first and second supporting portions, the pair of extending recesses extending in the first direction, and the pair of extending recesses being formed on both sides of the first and second supporting portions.

* * * * *